US007731785B2

(12) United States Patent
Choi et al.

(10) Patent No.: US 7,731,785 B2
(45) Date of Patent: Jun. 8, 2010

(54) HEAT EXCHANGER UNIT FOR IMPROVING HEAT EXCHANGE EFFICIENCY AND AIR CONDITIONING APPARATUS HAVING THE SAME

(75) Inventors: Seok-Ho Choi, Seoul (KR); Dong Soo Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 916 days.

(21) Appl. No.: 11/538,901

(22) Filed: Oct. 5, 2006

(65) Prior Publication Data

US 2007/0119206 A1 May 31, 2007

(30) Foreign Application Priority Data

Oct. 5, 2005 (KR) ..... 10-2005-0093553

(51) Int. Cl.
*F24F 3/14* (2006.01)
*B01D 53/06* (2006.01)
*F28F 13/08* (2006.01)

(52) U.S. Cl. ..... 96/126; 96/146

(58) Field of Classification Search ..... 96/125, 96/126, 143, 146; 62/476, 483
See application file for complete search history.

(56) References Cited

U.S. PATENT DOCUMENTS 2,181,927 A * 12/1939 Townsend ..... 165/147
5,086,835 A * 2/1992 Shinmura ..... 165/144
5,743,328 A * 4/1998 Sasaki et al. ..... 165/144
5,934,367 A 8/1999 Shimmura et al.
6,165,254 A * 12/2000 Kawakami et al. ..... 96/125
6,868,693 B2 3/2005 Choi et al.
6,874,334 B2 4/2005 Kim et al.
6,918,264 B2 7/2005 Park et al.
7,104,087 B2 9/2006 Park et al.
7,121,110 B2 10/2006 Yum et al.
7,124,595 B2 10/2006 Park et al.
2004/0159121 A1 8/2004 Horiuchi et al.

(Continued)

FOREIGN PATENT DOCUMENTS

DE 19804389 8/1998

(Continued)

OTHER PUBLICATIONS

English Language Abstract of JP 2002-326012, Nov. 2002.

(Continued)

*Primary Examiner*—Frank M Lawrence
(74) *Attorney, Agent, or Firm*—Birch, Stewart, Kolasch & Birch, LLP

(57) ABSTRACT

A heat exchanger unit of the air conditioning apparatus includes a first heat exchanger including a first body, a first introduction opening provided at an upper end portion of the first body, and a first discharge opening formed at a corner portion on one side of a lower end portion of the first body and having an elliptic shape; and a second heat exchanger including a second body, a second introduction opening connected to the first discharge opening, provided at a corner portion on one side of a lower portion of the second body, and having an elliptic shape corresponding to that of the first discharge opening, and a second discharge opening provided at a corner portion on the other side of an upper end portion of the second body.

18 Claims, 9 Drawing Sheets

U.S. PATENT DOCUMENTS

| | | | |
|---|---|---|---|
| 2004/0194482 | A1 | 10/2004 | Lee et al. |
| 2004/0226711 | A1 | 11/2004 | Jang et al. |
| 2004/0244401 | A1 | 12/2004 | Lee et al. |
| 2006/0015974 | A1 | 1/2006 | Ike |

FOREIGN PATENT DOCUMENTS

| | | |
|---|---|---|
| EP | 0849557 | 6/1998 |
| EP | 1515096 | 3/2005 |
| JP | 2002-326012 | 11/2002 |

OTHER PUBLICATIONS

English Language Abstract of DE 19804389, Aug. 1998.

* cited by examiner

HEAT EXCHANGER UNIT FOR IMPROVING HEAT EXCHANGE EFFICIENCY AND AIR CONDITIONING APPARATUS HAVING THE SAME

BACKGROUND OF THE INVENTION

1. Field of the Invention

The present invention relates to an air conditioning apparatus, and more particularly to a heat changer unit of an air conditioning apparatus including a dehumidifying function.

2. Description of the Related Art

An air conditioning apparatus including a dehumidifying function can be categorized into two types based on the dehumidifying method, that is, a cooling type and a non-cooling type.

The cooling dehumidification type air conditioning apparatus performs dehumidification by cooling an exterior air making contact with an evaporator to a temperature below a dew point and liquefying moisture contained in the exterior air. In the cooling dehumidification type, the exterior air is discharged into an interior of a room in the cooled state so that temperature of the interior of the room cannot be constantly maintained. Further, since the moisture cannot be liquefied in a case in which the temperature difference between the evaporator and the interior of the room is not large, dehumidification cannot be performed. Furthermore, since the evaporator should maintain a cooled state at the temperature below the dew point of the exterior air, excessive energy should be used, thereby increasing the maintenance cost. For those reasons, the non-cooling dehumidifying method is used which does not cool the exterior air.

A general air conditioning apparatus of the non-cooling dehumidification type includes a desiccant unit for removing moisture from the introduced exterior air, a heater unit for removing the moisture from the desiccant unit and drying and reproducing the desiccant unit, a fan motor unit for blowing the reproduction air heated by the heater unit to the desiccant unit, and a heat exchanger unit for allowing the reproduction air of a high temperature and a high humidity, which has passed through the desiccant unit, to exchange heat with the exterior air.

As shown in FIG. 1, the heat exchanger unit includes a first heat exchanger 10 and a second heat exchanger 20.

A first introduction opening 12 through which the reproduction air of a high temperature and a high humidity, which has passed through the desiccant unit, is provided at an upper end portion of the first heat exchanger 10 and a first discharge opening 14 through which the reproduction air introduced through the introduction opening 12 is discharged is provided at a corner portion of one side of a lower end portion thereof.

A second introduction opening 22 connected to the first discharge opening 14 is provided at a corner portion on one side of a lower end portion of the second heat exchanger 20 and a second discharge opening 24 through which the reproduction air introduced through the second introduction opening 22 is provided at a corner portion of the other side of an upper end portion thereof.

On the other hand, a plurality of interior passages are formed in the interiors of the first and second heat exchangers 10 and 20, respectively, and slits S through which the exterior air passes are formed between the interior passages.

The efficiency of the heat exchanger unit having the above-mentioned structure depends on flow uniformity of the reproduction air in the first and second heat exchangers 10 and 20 and the paths along which the reproduction air passes through the first and second heat exchangers 10 and 20. In other words, as the flow uniformity of the reproduction air becomes higher and the path of the reproduction air becomes longer, the heat exchange efficiency is improved further. For the reason, the first discharge opening 14 and the second introduction opening 22 are located at corner portions on sides of lower end portions of the first and second heat exchangers 10 and 20, and the second discharge opening 24 is located at a corner portion on the other side of an upper end portion of the second heat exchanger.

According to the structure of the introduction openings 12 and 22 and the discharge openings 14 and 24, the flow path of the reproduction air can be lengthened but the flow amount of the reproduction air decreases excessively at a corner portion on the other side of a lower end portion of the first heat exchanger 10 and at a corner portion on the other side of a lower end portion and a corner portion on one side of an upper end portion of the second heat exchanger 20. The heat exchange efficiency of the heat exchanger unit lowers due to the decreased flow uniformity. If the heat exchange efficiency drops, the devaporizing efficiency by which the reproduction air removes the moisture from the desiccant unit also lowers, thereby decreasing the dehumidifying efficiency of the air conditioning apparatus.

SUMMARY OF THE INVENTION

Accordingly, the present invention has been made to solve the above-mentioned problems occurring in the prior art, and an object of the present invention is to provide a heat exchanger unit for improving the heat exchange efficiency.

It is another object of the present invention to provide an air conditioning apparatus for improving the dehumidifying efficiency.

In order to achieve the above-mentioned objects, there is provided a heat exchanger unit, comprising: a first heat exchanger including, a first body in which a plurality of first slits through which exterior air passes are formed and a plurality of first interior passages are formed between the first slits, a first introduction opening provided at an upper end portion of the first body, through which reproduction air for exchanging heat with the exterior air is introduced, and a first discharge opening formed at a corner portion on one side of a lower end portion of the first body and having an elliptic shape, the major axis(MA) of which is disposed from one side of the first body to the other side thereof; and a second heat exchanger including, a second body in which a plurality of second slits through which the exterior air passes are formed and a plurality of second interior passages are formed between the second slits, a second introduction opening connected to the first discharge opening, provided at a corner portion on one side of a lower portion of the second body, and having a shape corresponding to the first discharge opening, and a second discharge opening provided at a corner portion on the other side of an upper end portion of the second body, for discharging the reproduction air introduced through the second introduction opening from the second body.

Here, it is preferable that the first heat exchanger include at least one first auxiliary discharge opening separated from the first discharge opening toward the other side in the first body, and the second heat exchanger include at least one second auxiliary introduction opening connected to the first auxiliary discharge opening and separated from the second introduction opening toward the other side in the second body.

Further, it is preferable that the first auxiliary discharge opening and the second auxiliary introduction opening be smaller than the first discharge opening and the second introduction opening, respectively, a plurality of first auxiliary discharge openings be formed in the first body so as to become gradually smaller as they go from the first discharge opening toward the other side, and a plurality of second auxiliary introduction openings be formed in the second body so as to become gradually smaller as they go from the second introduction opening toward the other side.

The above-mentioned objects can be achieved by a heat exchanger unit, comprising: a first heat exchanger including, a first body in which a plurality of first slits through which exterior air passes are formed and a plurality of first interior passages are formed between the first slits, a first introduction opening provided at an upper end portion of the first body, through which reproduction air for exchanging heat with the exterior air is introduced, and a plurality of first discharge openings provided so as to become gradually smaller as they go from a corner portion on one side of a lower end portion of the first body toward a corner portion on the other side of a lower end portion thereof, for discharging the reproduction air introduced through the introduction opening from the first body; and a second heat exchanger including, a second body in which a plurality of second slits through which the exterior air passes are formed and a plurality of second interior passages are formed between the second slits, a second introduction opening connected to the first discharge opening and provided at a lower end portion of the second body so as to correspond to that of the first discharge opening, and a second discharge opening provided at a corner portion on the other side of an upper end portion of the second body, for discharging the reproduction air introduced through the second introduction opening from the second body.

The above-mentioned objects can be achieved by a heat exchanger unit, comprising: a first heat exchanger including, a first body in which a plurality of first slits through which exterior air passes are formed and a plurality of first interior passages are formed between the first slits, a first introduction opening provided at an upper end portion of the first body, for introducing reproduction air for exchanging heat with the exterior air, and a first discharge opening provided in the form of a slit so that a gap thereof becomes gradually smaller as it goes from a corner portion on one side of a lower end portion of the first body toward a corner portion on the other side of a lower end portion thereof, for discharging the reproduction air introduced through the first introduction opening from the first body; and a second heat exchanger including, a second body in which a plurality of second slits through which the exterior air passes are formed and a plurality of second interior passages are formed between the second slits, a second introduction opening connected to the first discharge opening and provided in the form of a slit so that a gap(G) thereof becomes gradually smaller as it goes from a corner portion on one side of a lower end portion of the second body toward a corner portion on the other side of a lower end portion thereof, and a second discharge opening provided in the form of a slit so that a gap(G) thereof becomes gradually smaller as it goes from a corner portion on the other side of an upper end portion of the second body toward a corner portion on one side of an upper end portion thereof, for discharging the reproduction air introduced through the second introduction opening from the second body.

The above-mentioned objects can be achieved by an air conditioning apparatus, comprising: a desiccant unit absorbing moisture from exterior air; an exterior air fan motor unit absorbing the exterior air to the desiccant unit and discharging the exterior air from which the moisture is removed by the desiccant unit to the outside; a heater unit heating reproduction air to remove the moisture absorbed by the desiccant unit; a reproduction air fan motor unit for blowing the reproduction air heated by the heater unit to the desiccant unit; a first heat exchanger including a first body in which an interior passage is formed, a first introduction opening provided at an upper end portion of the first body, through which the reproduction air, which has passed the desiccant unit, is introduced into the interior of the first body, and a first discharge opening formed at a corner portion on one side of a lower end portion of the first body and having an elliptic shape, the major axis(MA) of which is disposed from one side of the first body to the other side thereof so that the reproduction air can uniformly flow in the interior passage of the first body, for discharging the reproduction air introduced through the first introduction opening from the first body; and a second heat exchanger including a second body in which an interior passage is formed, a second introduction opening connected to the first discharge opening, provided at a corner portion on one side of a lower portion of the second body, and having an elliptic shape corresponding to that of the first discharge opening, and a second discharge opening provided at a corner portion on the other side of an upper end portion of the second body, for discharging the reproduction air introduced through the second introduction opening to the fan motor unit for reproduction air.

The above-mentioned objects can be achieved by an air conditioning apparatus, comprising: a desiccant unit absorbing moisture from exterior air; an exterior air fan motor unit absorbing the exterior air to the desiccant unit and discharging the exterior air from which the moisture is removed by the desiccant unit; a heater unit heating reproduction air to remove the moisture absorbed by the desiccant unit; a reproduction air fan motor unit for blowing the reproduction air heated by the heater unit to the desiccant unit; a first heat exchanger including a first body in which an interior passage is formed, a first introduction opening provided at an upper end portion of the first body, for introducing the reproduction air, which has passed through the desiccant unit, into the interior of the first body, and a plurality of first discharge openings provided so as to become gradually smaller as they go from a corner portion on one side of a lower end portion of the first body toward a corner portion on the other side of a lower end portion thereof, for discharging the reproduction air introduced through the first introduction opening from the first body; and a second heat exchanger including a second body in which an interior passage is formed, a plurality of second introduction openings connected to the first discharge openings and provided in the second body so as to become gradually smaller as they go from a corner portion on the other side of the second body toward a corner portion on the other side thereof, and a second discharge opening provided at a corner portion on the other side of an upper end portion of the second body, for discharging the reproduction air introduced through the second introduction opening to the reproduction air fan motor unit.

The above-mentioned objects can be achieved by an air conditioning apparatus, comprising: a desiccant unit absorbing moisture from exterior air; an exterior air fan motor unit absorbing the exterior air to the desiccant unit and discharging the exterior air from which the moisture is removed by the desiccant unit; a heater unit heating reproduction air to remove the moisture absorbed by the desiccant unit; a reproduction air fan motor unit for blowing the reproduction air heated by the heater unit to the desiccant unit; a first heat exchanger including a first body in which an interior passage is formed, a first introduction opening provided at an upper end portion of the first body, for introducing the reproduction air, which has passed through the desiccant unit, into the interior of the first body, and a first discharge opening provided in the form of a slit, a gap(G) of which becomes gradually smaller as it goes from a corner portion of one side of a lower end portion of the first body toward a corner portion on the other side thereof, for discharging the reproduction air introduced through the first introduction opening from the first body; and a second heat exchanger including a second body in which an interior passage is formed, a second introduction opening provided in the form of a slit, a gap(G) of which becomes gradually smaller as it goes from a corner portion of one side of a lower end portion of the second body toward a corner portion on the other side thereof, and a second discharge opening is provided in the form of a slit, a gap(G) of which becomes gradually smaller as it goes from a corner portion of the other side of an upper end portion of the second body toward a corner portion on one side of an upper end portion thereof, for discharging the reproduction air introduced through the second introduction opening from the second body.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE INVENTION

Hereinafter, an air conditioning apparatus according to preferred embodiments of the present invention will be described in detail.

Figure 2:
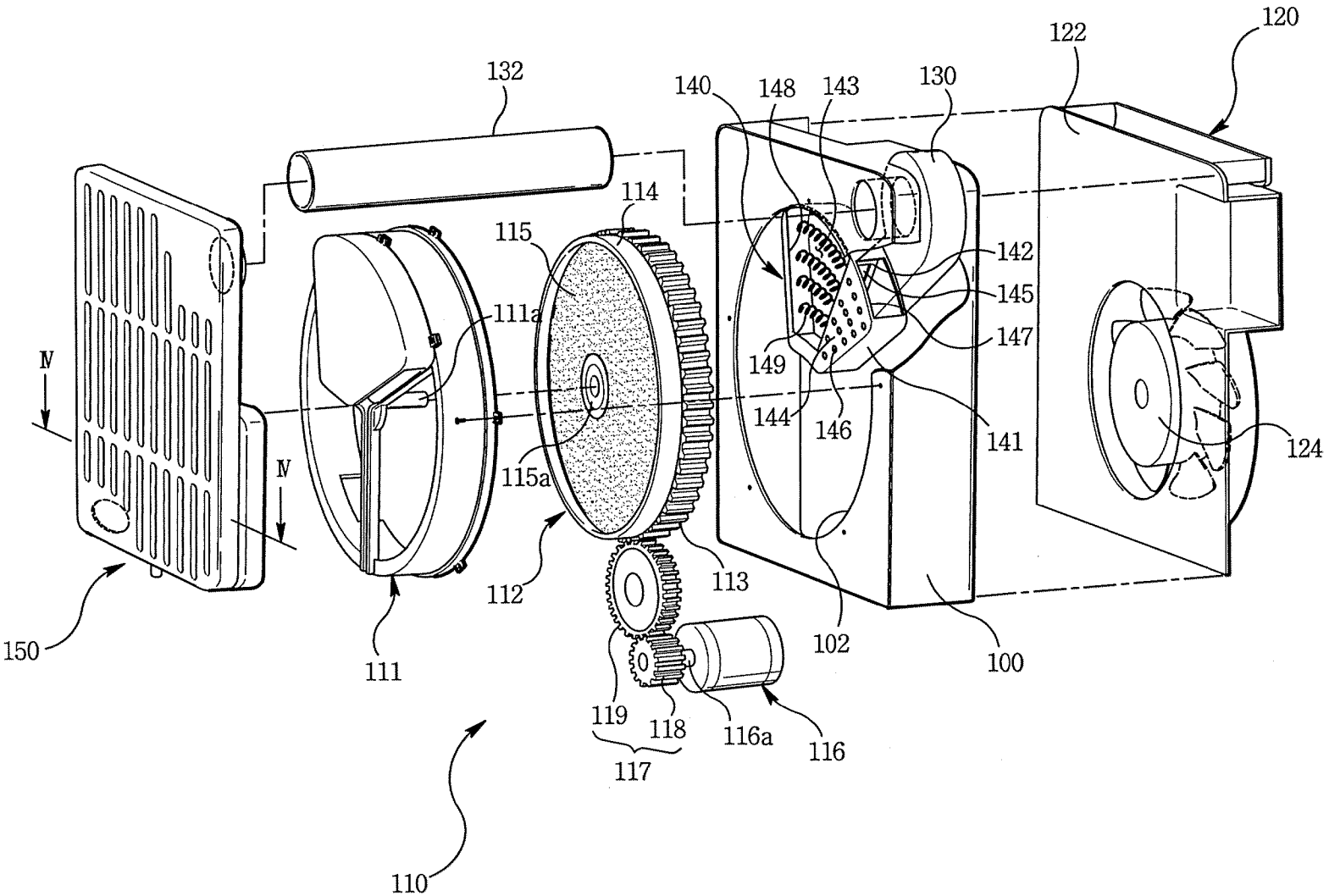
FIG. 2 is an exploded perspective view schematically showing an air conditioning unit according to a first preferred embodiment of the present invention.

Referring to FIG. 2, an air conditioning apparatus according to a first preferred embodiment of the present invention includes a frame 100, a desiccant unit 110, an exterior air fan motor unit 120, a reproduction air fan motor unit 130, a heater unit 140, and a heat exchanger unit 150.

An accommodation portion with which the desiccant unit 100 is engaged is provided on one surface of the frame 100 and the exterior air fan motor unit 120 is engaged with the other surface thereof. The reproduction air fan motor unit 130 and the heater unit 140 are installed in the interior of the frame 100. The frame 100 is supported by a body frame (not shown).

The desiccant unit 110 includes a rotor case 111, a desiccant rotor 112 rotatably installed in the rotor case 111, a drive motor 116 for rotating the desiccant rotor 112, and a power transmitting member 117 for transmitting the power of the drive motor to the desiccant rotor 112.

The rotor case 111 is engaged with the accommodation portion 102 of the frame 100 by a screw and the like and a shaft 111*a* with which the desiccant rotor 112 is engaged is formed at a central portion of the rotor case 111.

The desiccant rotor 112 includes an outer rim 114 in which a gear 113 is formed along the outer peripheral surface thereof and a desiccant 115 engaged with the interior of the outer rim 114. Generally, the desiccant 115 has a strong attraction to humidity and refers to a material which can absorb moisture directly from the surrounding air. For example, the desiccant 115 has a cylindrical shape in which flat sheets and wavy sheets of a ceramic fiber are wound by turns in the interior thereof. Silica gel is coated in the interior of the desiccant 115 and a plurality of minute holes may be formed on the surface thereof.

Figure 5:
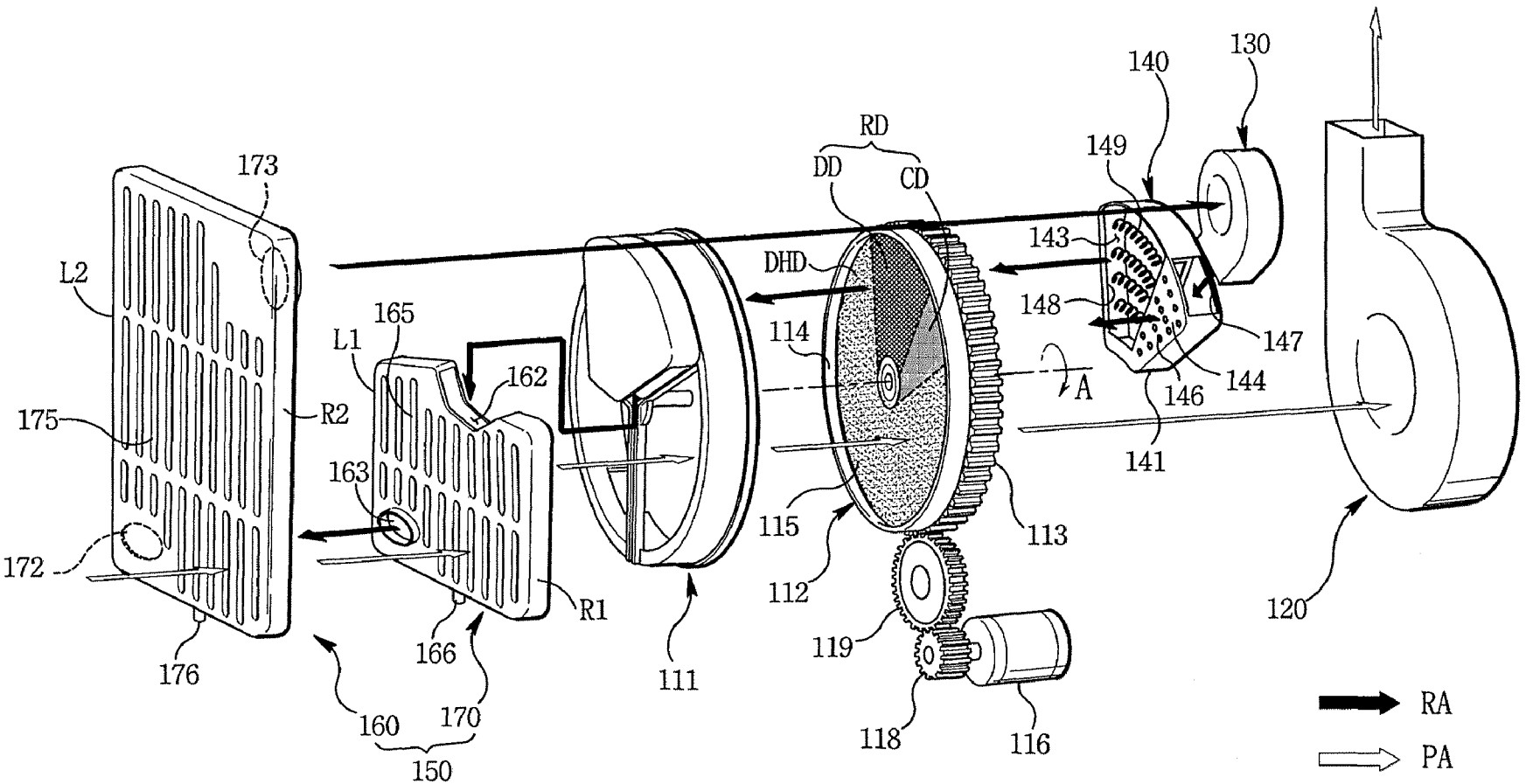
FIG. 5 is a view for explaining the operation of the air conditioning apparatus shown in FIG. 1.

As shown in FIG. 5, the desiccant 115 may be divided into a dehumidification domain DHD for absorbing moisture from exterior air and a reproduction domain RD for removing the moisture absorbed from the exterior air. The reproduction domain RD is divided into a drying domain DD for drying the absorbed moisture and a cooling domain CD for cooling the desiccant 115 heated by the drying domain DD. The structure of the desiccant 115 is a well-known technology and the detailed description of the structure and function thereof will be omitted. The desiccant 115 is engaged with a bearing 115*a* engaged with the shaft 111*a* of the rotor case 111 so that the desiccant rotor 112 can be rotatably supported by the rotor case 111.

The drive motor 116 is a drive source for rotating the desiccant rotor 112 and is supported by the body frame (not shown). The drive motor 116 is electrically connected to a control unit (not shown) so as to communicate with the control unit and is driven by electrical signals from the control unit by periods or according to data values.

The power transmitting member 117 includes a driving gear 118 provided at one end of a drive shaft 116*a* of the drive motor 116 and a driven gear 119 geared with the driving gear 118. The driven gear 119 is engaged with the gear 113 formed in the outer rim 114. Therefore, if the drive motor 116 is driven, the driven gear 119 is rotated by the rotation of the driving gear 118 and the driven gear 119 rotates the outer rim 114. In the preferred embodiment, although the driving gear 118 and the driven gear 119 are exemplified as the power transmitting member 117, various other power transmitting units such as a pulley or a driving belt may be used.

The exterior air fan motor unit 120 includes a duct 122 for inducing discharge of exterior air and a blowing fan 124 installed in the duct 122. The duct 122 is engaged with the other surface of the frame 100 by using a screw or the like. If the exterior air fan motor unit 120 is driven, the exterior air to be dehumidified is introduced through an introduction opening formed in the body frame (not shown). The introduced exterior air sequentially passes through the heat exchanger unit 150, the desiccant 115, and the accommodation portion 102 of the frame 100 and is introduced into the duct 122. The air introduced into the duct 122 is discharged outside through a discharge opening formed in the body frame (not shown).

The reproduction air fan motor unit 130 is adapted to circulate the reproduction air and is supported by the frame 100. An inlet of the reproduction air fan motor unit 130 is connected to a duct 132 for reproduction air and an outlet thereof is connected to an introduction opening 147 of the heater unit 140. More particularly, the reproduction air fan motor unit 130 compulsorily blows the reproduction air of a low temperature, which has passed through the heat exchanger unit 150 and has been dried, to the introduction opening 147 of the heater unit 140.

The heater unit 140 includes a heater case 141 and a heat radiating body 149.

The heater case 141 is divided by a partition wall 142 into a heating section 143 in which the heat radiating body 149 is installed and a purge section 144 for blowing the reproduction air, which has not been heated, to the desiccant 115. A connection hole 145 is formed in the partition wall 142 and the heating section 143 and the purge section 144 communicate with each other through the connection hole 145. Further, the introduction opening 147 communicated with the outlet of the reproduction air fan motor unit 130 is provided in the purge section 144 of the heater case 141. A plurality of discharge holes 146 for discharging the air introduced through the introduction opening 147, which has not been heated, to the cooling domain CD (refer to FIG. 5) of the desiccant 115 are formed on a surface of the purge section 144, which is opposite to the desiccant 115. A discharge opening 148 for discharging the reproduction air to the desiccant 115 is provided on a surface of the heating section 143, which is opposite to the desiccant 115.

The heat radiating body 149 is adapted both to heat the reproduction air to be discharged to the drying domain DD (FIG. 5) of the desiccant 115 and to transfer the radiant heat to the drying domain DD (FIG. 5) of the desiccant 115 and includes a plurality of heating coils 149. The heating coils 149 may be manufactured by various methods such as winding nichrome wires on a mica plate. Further, unlike the preferred embodiment, various heat radiating devices such as a thermoelectric device may be used as the heat radiating body 149.

Figure 3:
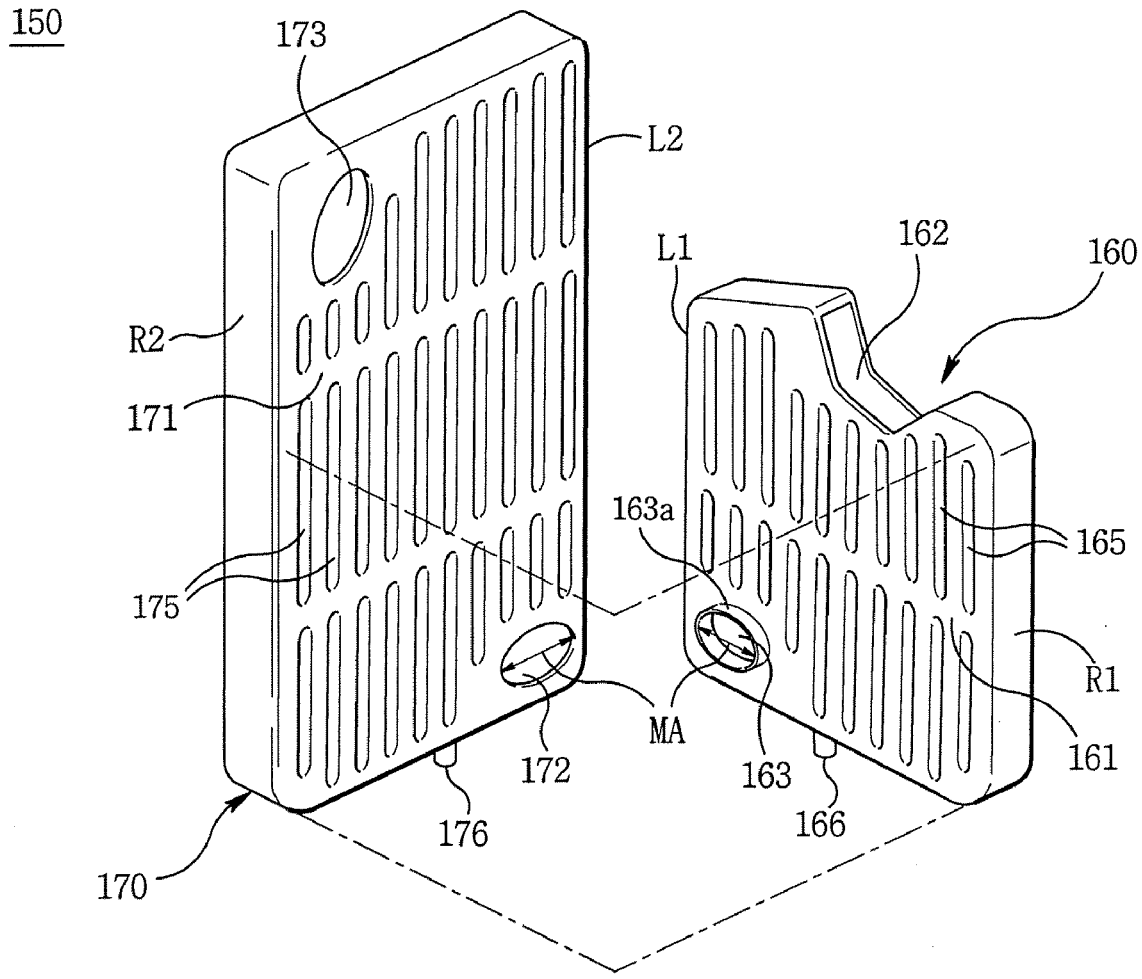
FIG. 3 is an exploded perspective view schematically showing a heat exchanger unit of the air conditioning apparatus shown in FIG. 2.
Figure 4:
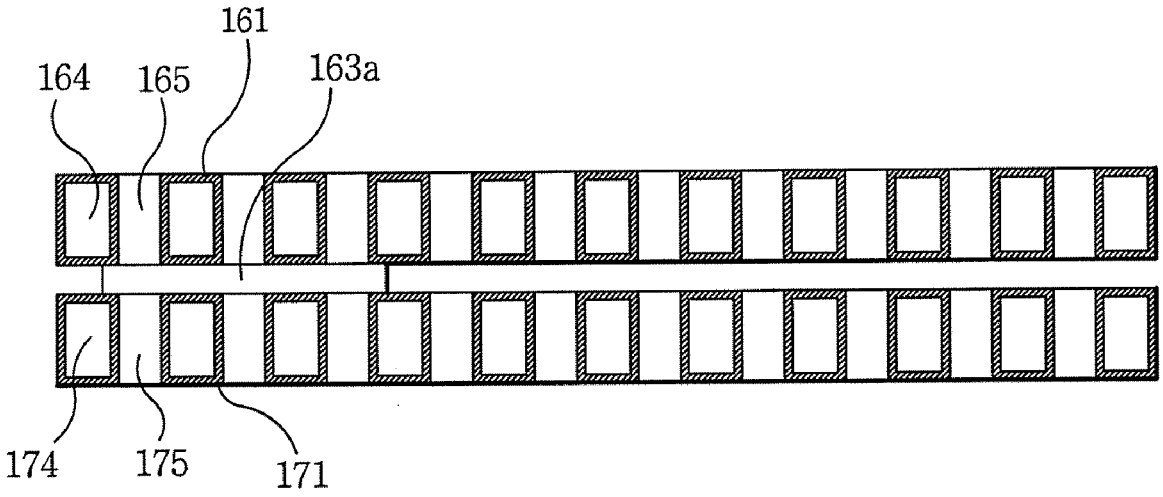
FIG. 4 is a cross-sectional view taken along line IV-IV of FIG. 2.

Referring to FIGS. 3 and 4, the heat exchanger unit 150 is supported by the body frame (not shown) and includes first and second heat exchangers 160 and 170 each communicating there between.

The first heat exchanger 160 includes a first body 161, a first introduction opening 162 provided at an upper end portion of the first body 161, and a first discharge opening 163 provided at a corner portion on one side L1 of a lower end portion of the first body 161.

A plurality of first interior passages 164 through which the reproduction air introduced through the first introduction opening passes are formed in the first body 161. First slits 165 through which the exterior air passes are formed between the first interior passages 164.

The first introduction opening 162 communicates with the rotor case 111 (refer to FIG. 2) and the reproduction air which has passed through the desiccant 115 is introduced through the first introduction opening 162. The first introduction opening 162 is formed at a central portion of the upper end of the first body 161 and has a shape in which the reproduction air can be introduced through the lower side and both sides of the central portion. By the shape, the reproduction air of a high temperature and a high humidity, which has passed through the desiccant 115, is introduced into the first interior passages 164 more uniformly. However, the flow amount distribution in the first interior passages 164 depends on the flow resistances in the passages and the position of the first discharge opening 163. Therefore, the structure of the first discharge opening 163 for improving the uniformity of the flow amount in the first interior passages will be explained hereinafter.

As mentioned above, the first discharge opening 163 is provided at a corner portion on one side of a lower end portion of the first body 161 and an engagement rib 163*a* inserted into and engaged with a second introduction opening 172 of a second heat exchanger 170 (described later) is provided at the periphery of the first discharge opening 163. The first discharge opening 163 has an elliptic cross-section. The elliptic major axis (MA) is disposed from one side (L1) of a lower end portion of the first body 161 toward the other side (R1) thereof. Namely, the first discharge opening 163 has an elliptic shape flattened to the right and left sides of the first body 161 in the figure. By the structure, the shortest path from the first introduction opening 162 to the first discharge opening 163 is lengthened and the flow resistances of the first interior passages 164 from the first introduction opening 162 to the first discharge opening 163 increase. The increased flow resistances reduce the flow of the reproduction air introduced through the first introduction opening 162 along the shortest path to the first discharge opening 163, thereby increasing the flow of the reproduction air flowing through the first interior passages 164 on the other side R1 of the lower end portion of the first body 161. Therefore, the time for which the reproduction air passes through the first heat exchanger 160 increases, thereby improving the flow uniformity and thus improving the heat exchange efficiency.

Further, since the first discharge opening has the elliptic shape, the distance between the first discharge opening 163 and the other side R1 of the first body 161 is reduced so that the reproduction air can flow toward the other side R1 of the first body 161 much more, thereby improving the flow uniformity further.

Figure 1:
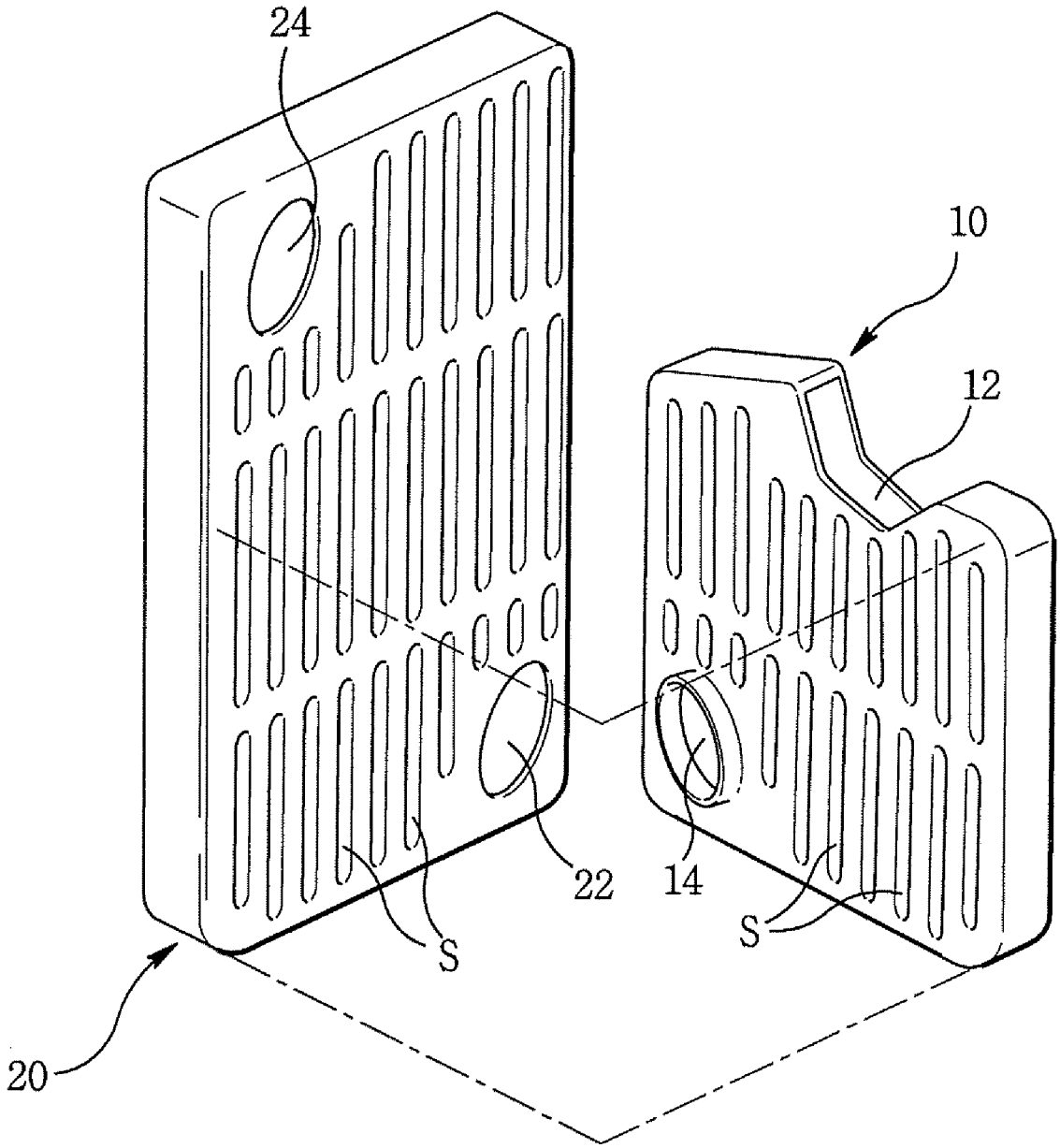
FIG. 1 (PRIOR ART)
FIG. 1 is a perspective view schematically showing a conventional heat exchanger unit.

In order to support the above-mentioned effects, computer simulation tests for measuring the flow disuniformities of the first heat exchanger 10 (FIG. 1) in which the circular first discharge opening 14 (FIG. 1) is formed and the first heat exchanger 160 in which the elliptic first discharge opening 163 is formed have been performed. The simulation test result shows that while the disuniformity of the conventional first heat exchanger 10 (FIG. 1) is 2.63, the flow disuniformity of the first heat exchanger 160 according to the first preferred embodiment is 2.38. Therefore, according to the simulation test result, the flow uniformity of the first heat exchanger 160 is enhanced by about 9.5 percent as compared with the conventional first heat exchanger 10.

According to the structure, the reproduction air introduced through the first introduction opening 162 exchanges heat with the exterior air passing through the first slits 165, while passing through the first interior passages 164. Then, the reproduction air is cooled to a temperature below the dew point, and the moisture contained in the reproduction air in the form of vapor is liquefied and is collected in a water collecting tub (not shown) through a first drain 166.

The second heat exchanger 170 includes a second body 171, a second introduction opening 172 provided at a corner portion on one side (L2) of a lower end portion of the second body 171, and a second discharge opening 173 provided at a corner portion on the other side R2 of an upper end portion of the second body 171.

A plurality of second interior passages 174 through which the reproduction air introduced through the second introduction opening 172 are formed in the second body 171 similarly to the first body 161 and second slits 175 through which the exterior air passes are formed between the second interior passages 174. However, the longitudinal length of the second body 171 is larger than that of the first body 161, which allows the second body 171 to be engaged with the fan motor unit 130 (FIG. 2) for reproduction air through the duct 132 (FIG. 2) for reproduction air without interference of the first body 161.

The second introduction opening 172 has a shape corresponding to the first discharge opening 163, i.e. the same elliptic shape, and the engagement rib 163*a* of the first discharge opening 163 is inserted into the second introduction opening 172 so that the second introduction opening 172 can be connected to the first discharge opening 163. Therefore, the reproduction air discharged through the first discharge opening 163 is introduced through the second introduction opening 172.

The second discharge opening 173 is provided at a corner portion of the other side (R2) of an upper end portion of the second body 171 and has a circular cross-section. One end of the duct 132 (FIG. 2) for reproduction air, the other end of which is connected to the inlet of the fan motor unit 130 (FIG. 2) for reproduction air, is inserted into the second discharge opening 173.

Since the second introduction opening 172 of the second heat exchanger 170 has the elliptic shape like that of the first discharge opening 163, the shortest path between the second introduction opening 172 and the second discharge opening 173 is lengthened, thereby increasing the flow resistances of the second interior passages 174. The increased flow resistances reduce the amount of the reproduction air introduced through the second introduction opening 172 and flowing to the second discharge opening 173 along the shortest path, thereby increasing the amount of the reproduction air flowing through the second interior passages 174 on the other side (R2) of a lower end portion of the second body 172 and on one side (L2) of an upper end portion thereof. Therefore, the flow uniformity as well as the time for which the reproduction air passes through the second heat exchanger 170 increases, thereby improving the heat exchange efficiency. Further, since the second introduction opening 172 has the elliptic shape, the distance between the second introduction opening 172 and the other side R2 of the second body 171 is shortened so that the reproduction air can flow toward the other side (R2) of the second body 171 much more, thereby improving the flow uniformity further.

In order to support the above-mentioned effects, computer simulation tests for measuring the flow disuniformities of the second heat exchanger 20 (FIG. 1) in which the circular second introduction opening 22 (FIG. 1) is formed and the second heat exchanger 170 in which the elliptic second introduction opening 172 is formed have been performed. The simulation test result shows that while the disuniformity of the conventional second heat exchanger 20 (FIG. 1) is 4.0, the flow disuniformity of the second heat exchanger 170 according to the first preferred embodiment is 3.02. Therefore, according to the simulation test result, the flow uniformity of the second heat exchanger 170 is enhanced by about 24.5 percent as compared with the conventional second heat exchanger 20.

According to the structure, the reproduction air introduced through the second introduction opening 172 exchanges heat with the exterior air passing through the second slits 175, while passing through the second interior passages 174. Then, the reproduction air is cooled to a temperature below the dew point, and the moisture contained in the reproduction air in the form of vapor is liquefied and is collected in a water collecting tub (not shown) through a second drain 176.

Hereinafter, the operation of the air conditioning apparatus according to the preferred embodiment of the present invention will be described with reference to FIG. 5.

Referring to FIG. 5, the exterior air (PA) passes through the slits 165 and 175 of the first and second heat exchangers 160 and 170 and is introduced into the dehumidification domain (DHD) of the desiccant 115 if the exterior air fan motor unit 120 is driven. The exterior air introduced into the dehumidification domain (DHD) of the desiccant is devaporized by the desiccant 115. More particularly, since the vapor pressure of a surface of the desiccant is lower than that of the exterior air PA, the moisture in the exterior air (PA) is absorbed to the desiccant 115. The exterior air (PA), the moisture of which is removed by the desiccant 115 is discharged outside by the exterior air fan motor unit 120.

On the other hand, the moisture absorbed by the desiccant 115 should be removed to repetitively use the desiccant 115. In order to remove the moisture, the desiccant 115 should be rotated to move the dehumidification domain (DHD) in which the moisture is absorbed to the drying domain (DD). For that, a control unit (not shown) drives the drive motor 116. If the drive motor 116 is driven, the driving gear 118 is rotated to rotate the driven gear 119. If the driven gear 119 is rotated, power is transmitted to the gear 113 formed along the periphery of the rim 114 and the desiccant rotor 112 is rotated in a direction (A) so that a portion of the desiccant 115, in which the moisture is absorbed, can reach the drying domain (DD). The control unit can not only continuously rotate the drive motor 116 but also control the rotation of the drive motor 116 according to the amount of the moisture absorbed in the desiccant 115.

If the moisture absorbing portion of the desiccant 115 reaches the drying domain (DD), the reproduction air (RA) heated by the heat radiating body 149 and the moisture heated by the radiant heat of the heat radiating body 149 and absorbed in the desiccant 115 are evaporated. More particularly, the surface of the desiccant 115 in the drying domain (DD) is heated so that the vapor pressure of the surface of the desiccant 115 is higher than that of the reproduction air RA, and thus the moisture in the desiccant is evaporated from the surface of the desiccant 115.

The desiccant 115 in which the moisture is removed in the drying domain (DD) is rotated further to reach the cooling domain (CD). If the desiccant 115 reaches the cooling domain (CD), the reproduction air, which has not been heated, is blown to the desiccant 115 through the discharge holes 146 of the purge section 144. Accordingly, the desiccant 115 is cooled and the vapor pressure of the surface of the desiccant 115 lowers. Therefore, the dehumidifying capacity of the desiccant 115, which has passed through the cooling domain (CD), is recovered and increased and the desiccant 115 can be moved to the dehumidification domain (DHD) to absorb the moisture from the exterior air (PA). The desiccant 115 can repetitively remove the moisture from the exterior air (PA) by repeating a series of above-mentioned processes.

Hereinafter, the circulation process of the reproduction air (RA) will be described. The reproduction air (RA) is introduced through the introduction opening 147 of the heater case 141 by driving the fan motor unit 130 for reproduction air. Some of the introduced reproduction air (RA) is blown to the cooling domain (CD) through the discharge holes 146 of the purge section 144 and some of the reproduction air passes through the heating section 143. The reproduction air (RA), which has passed through the heating section 143, is heated by the heat radiating body 149 to be the reproduction air of a high temperature. The reproduction air (RA) of the high temperature is blown to the drying domain (DD) through the discharge opening 148 of the heater case 141 and removes the moisture of the desiccant 115 located in the drying domain DD.

The reproduction air (RA) of a high temperature and a high humidity, which contains the moisture removed from the desiccant 115, is introduced through the first introduction opening 162 of the first heat exchanger 160. The reproduction air (RA) introduced through the first introduction opening 162 exchanges heat with the exterior air (PA) to be cooled while passing through the first interior passages 164 (FIG. 4), and thus the gaseous moisture contained in the reproduction air (RA) is liquefied and is collected in the water collecting tub (not shown) through the first drain 166.

The reproduction air (RA), which has passed through the first interior passages 164 (FIG. 4), is discharged through the first discharge opening 163 and is introduced through the second introduction opening 172 of the second heat exchanger 170. The reproduction air (RA) introduced through the second introduction opening 172 exchanges heat with the exterior air (PA) to be cooled while passing through the second interior passages 174 (FIG. 4), and thus the gaseous moisture contained in the reproduction air (RA) is liquefied and is collected in the water collecting tub (not shown) through the second drain 176.

Then, as mentioned above, since the first discharge opening 163 and the second introduction opening 172 have elliptic shapes, the flow uniformity is improved, thereby improving the heat exchange efficiency of the heat exchanger unit 150. If the heat exchange efficiency is improved, since the reproduction air (RA) passes through the desiccant 115 in a drier state, the desiccant 115 can absorb more moisture from the exterior air (PA), thereby improving the dehumidifying efficiency.

The reproduction air (RA), the moisture of which is removed when the reproduction air (RA) passes the first and second heat exchangers 160 and 170, is introduced into the fan motor unit 130 for reproduction air through the second discharge opening 173 and the duct 132 (FIG. 2) for reproduction air.

The process of dehumidifying the exterior air (PA) can be repetitively performed through the circulation of the reproduction air (RA) and the exterior air (PA).

Figure 6:
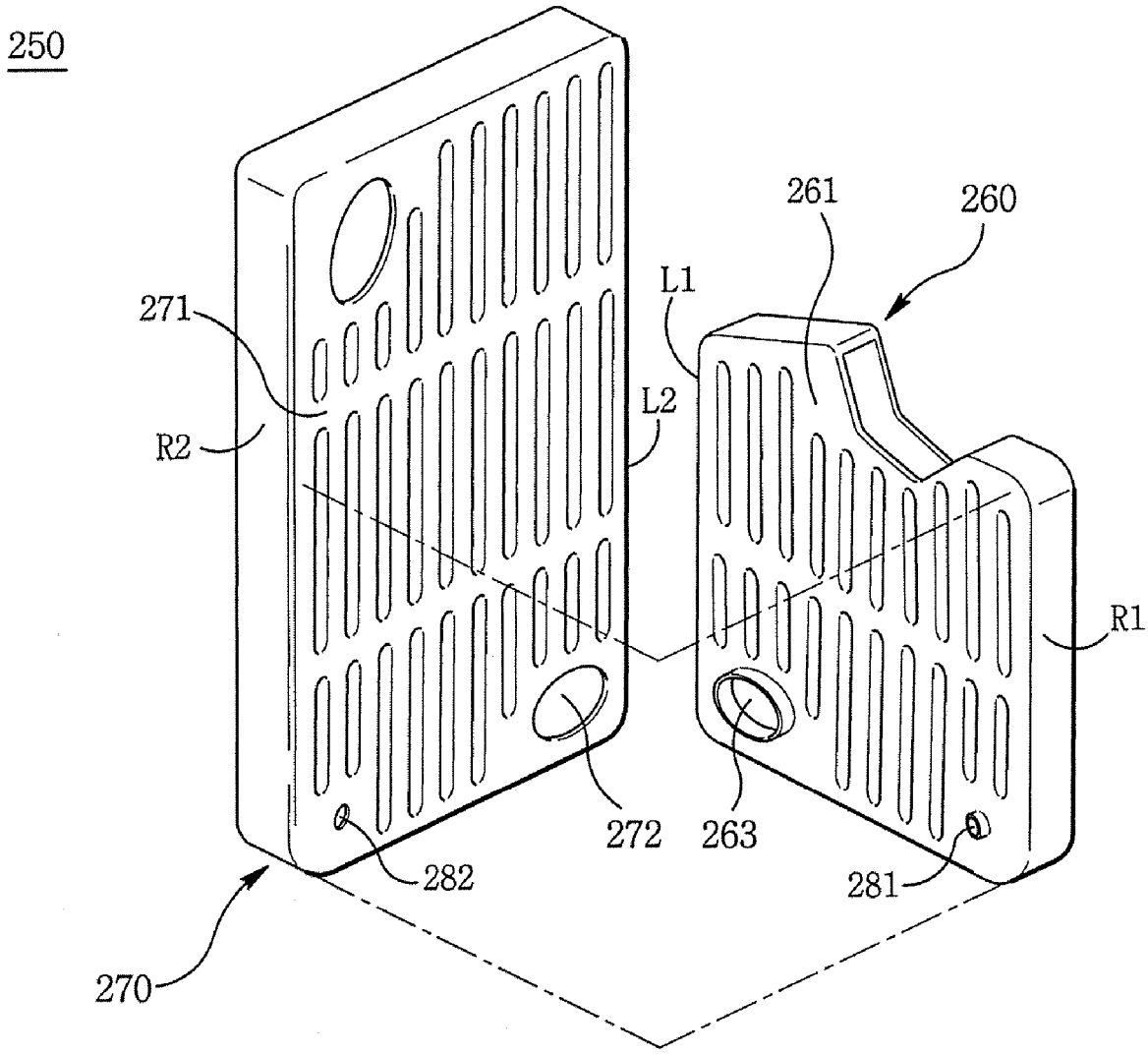
FIG. 6 is an exploded view schematically showing a heat exchanger unit according to a second preferred embodiment of the present invention.

Referring to FIG. 6, unlike the first preferred embodiment of the present invention, a heat exchanger unit 250 according to the second preferred embodiment of the present invention has a first auxiliary discharge opening 281 and a second auxiliary introduction opening 282 on the other sides of lower end portions of first and second bodies 261 and 271. The sizes of the first auxiliary discharge opening 281 and the second auxiliary introduction opening 282 are smaller than those of the first discharge opening 263 and the second introduction opening 272. Accordingly, the path along which the reproduction air passes can be lengthened as far as possible by making the flow amount of the reproduction air flowing through the first discharge opening 263 and the second introduction opening 272 larger than that of the reproduction air flowing through the first auxiliary discharge opening 281 and the second auxiliary introduction opening 282.

By the above-mentioned structure, the flow uniformities of first and second heat exchangers 260 and 270 are improved and thus the heat exchange efficiency is improved, thereby improving the dehumidifying efficiency of the air conditioning apparatus.

Figure 7:
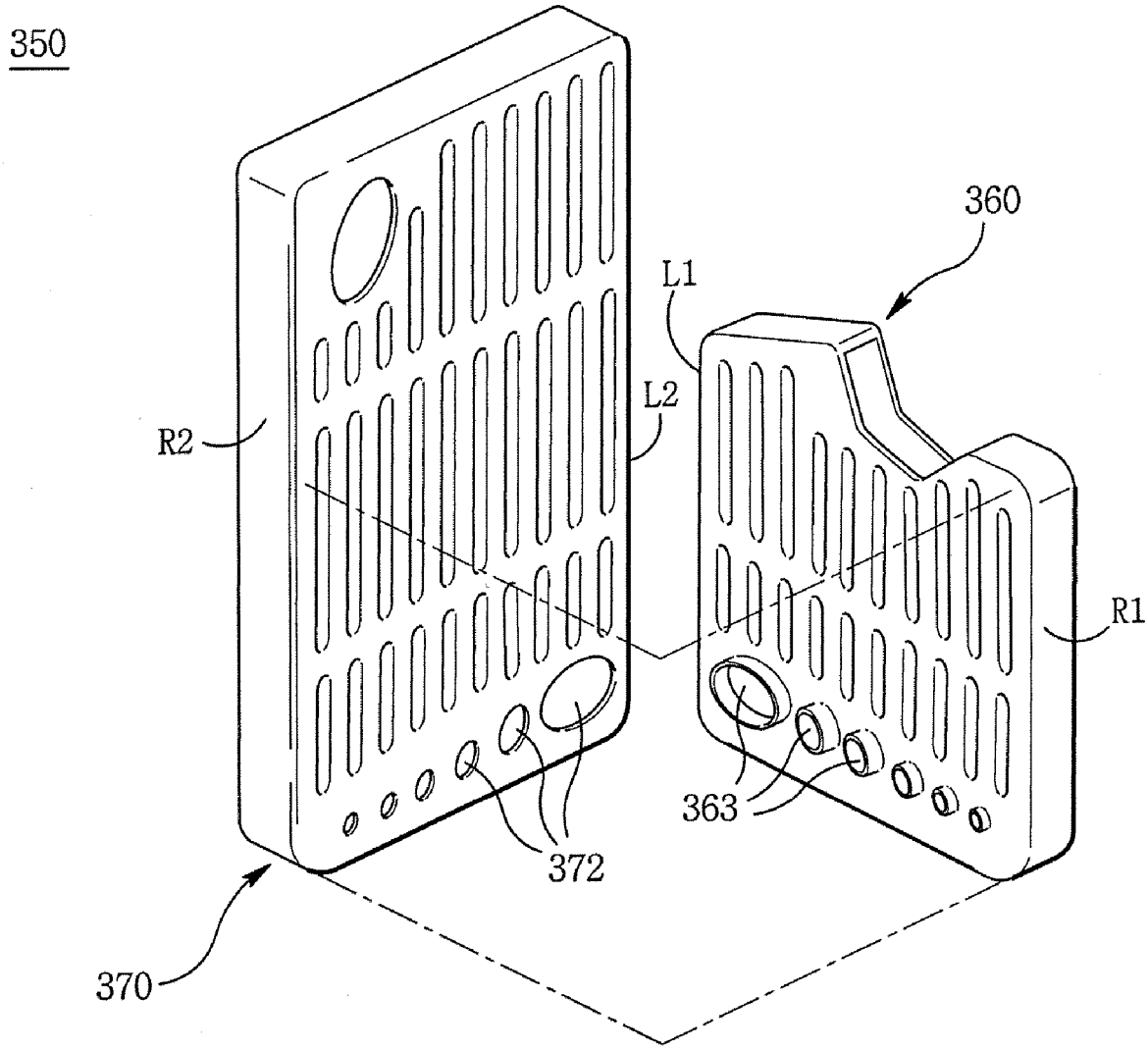
FIG. 7 is an exploded view schematically showing a heat exchanger unit according to a third preferred embodiment of the present invention.

FIG. 7 is a view showing a heat exchanger unit 350 according to the third preferred embodiment of the present invention. The heat exchanger unit 350 according to the third preferred embodiment of the present invention has a plurality of first discharge openings 363. The plurality of first discharge openings 363 become gradually smaller as they go from one side (L1) of the first body 361 toward the other side (R1). Further, second introduction openings 372 are formed at lower end portions of a second heat exchanger 370 so as to have the number and shapes corresponding to those of the first discharge openings 363.

By the structure, the flow uniformities of the first and second heat exchangers 360 and 370 are improved much more.

Figure 8:
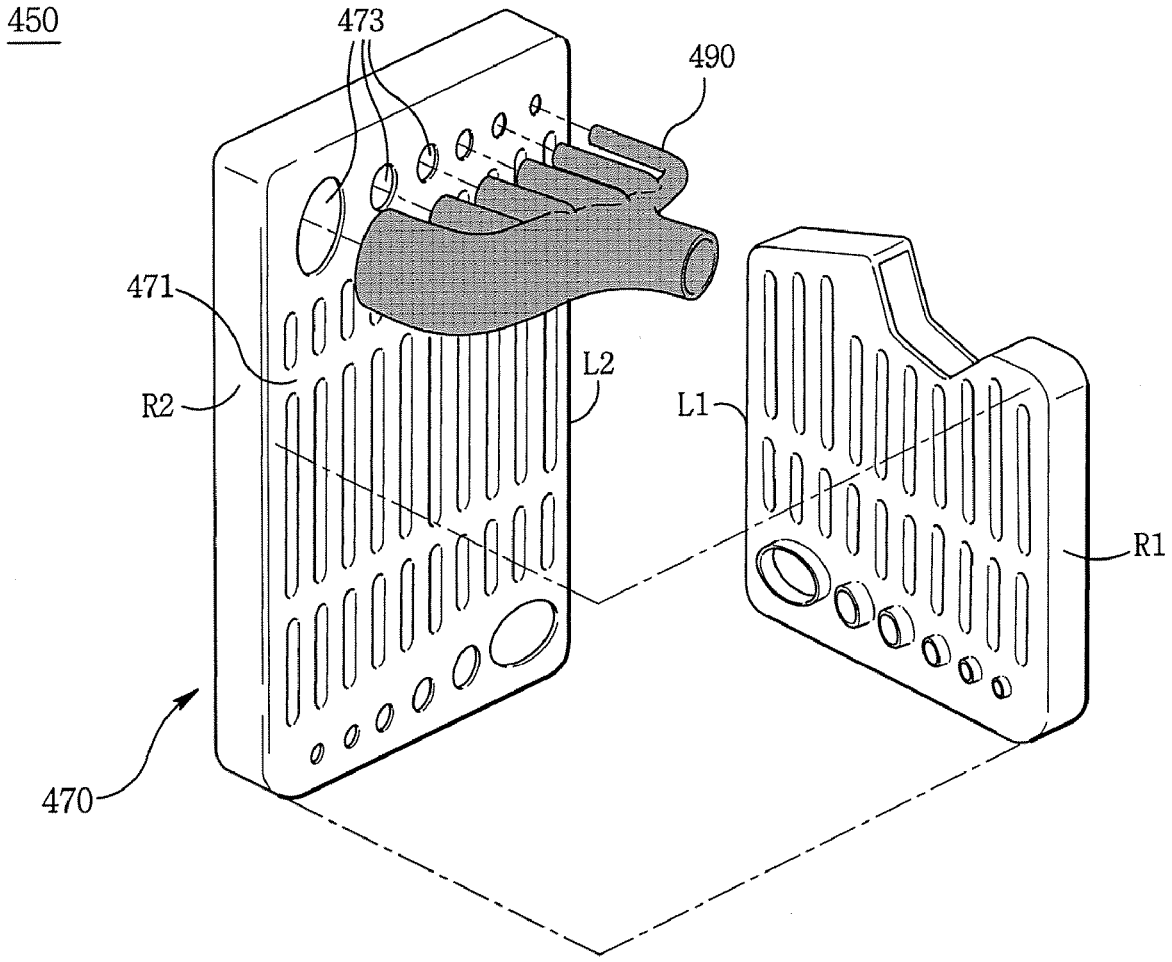
FIG. 8 is an exploded view schematically showing a heat exchanger unit according to a fourth preferred embodiment of the present invention.

FIG. 8 is a view showing a heat exchanger unit 450 according to the fourth preferred embodiment of the present invention. According to the fourth preferred embodiment of the present invention, unlike the third preferred embodiment, a plurality of second discharge openings 473 are provided in a second heat exchanger 470. The second discharge openings 473 become gradually smaller as they go from the other side (R2) of an upper end portion of the second body 471 toward one side thereof.

Further, according to the fourth preferred embodiment of the present invention, the plurality of second discharge openings 473 and the duct 132 (FIG. 2) for reproduction air are connected by a connection member 490. A plurality of introduction openings connected to the plurality of second discharge openings 473 are provided at one end of the connection member 490 and one discharge opening for converging the reproduction air introduced through the plurality of introduction openings and discharging the reproduction air to the duct 132 for reproduction air is formed at the other end thereof.

Therefore, by forming the plurality of second discharge openings 473, the flow uniformity of the second body 471 is maximized, thereby improving the heat exchange efficiency of the second heat exchanger 470 further.

Figure 9:
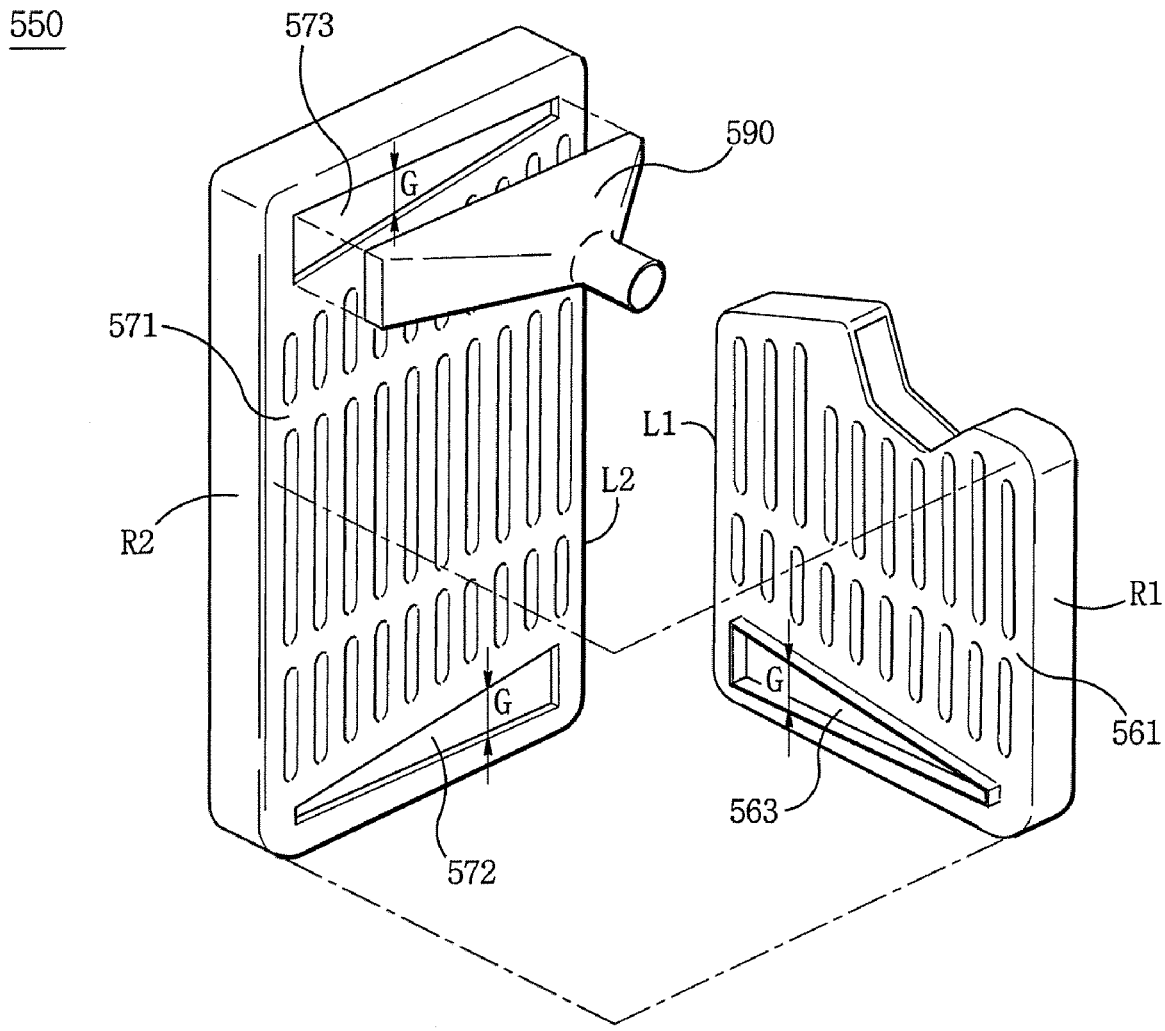
FIG. 9 is an exploded view schematically showing a heat exchanger unit according to a fifth preferred embodiment of the present invention.

FIG. 9 is a view showing a heat exchanger unit 550 according to the fifth preferred embodiment of the present invention. According to the fifth preferred embodiment of the present invention, a first discharge opening 563 has the form of a slit from a corner portion on one side (L1) of a lower end portion of a first body 561 to a corner portion on the other side thereof. A gap (G) of the slit becomes gradually smaller as it goes from one side (L1) of a lower end portion of the first body 561 toward the other side thereof.

In correspondence to the first discharge opening 563, a second introduction opening 572 has the form of a slit, the gap of which becomes gradually smaller as it goes from one side (L2) of a second body 571 toward the other side (R2) thereof.

On the other hand, the second discharge opening 573 has the form of a slit, the gap (G) of which becomes smaller as it goes from a corner portion on the other side R2 of an upper end portion of the second body 571 toward a corner portion on one side (L2) thereof.

Further, according to the fifth preferred embodiment of the present invention, a connection member 590 connects the second discharge opening 573 and the duct 132 (FIG. 2) for reproduction air. One end of the connection member 590 has a shape corresponding to the second discharge opening 573 and is inserted into the second discharge opening 573 to be engaged with the second discharge opening 573 and the other end thereof is connected to the duct 132 (FIG. 2) for reproduction air.

By the above-mentioned structure, the flow path of the reproduction air can be lengthened to a maximum and the flow uniformity of the reproduction air can be maximized, thereby maximizing the heat exchange efficiency of the heat exchanger unit 550.

As mentioned above, according to the present invention, by forming the first discharge opening of the first heat exchanger and the second introduction opening of the second heat exchanger so as to have elliptic shapes, the flow uniformities of the reproduction air in the first and second interior passages are improved, thereby improving the heat exchange efficiency of the heat exchanger unit.

Further, according to the present invention, by forming the first auxiliary discharge opening and the second auxiliary introduction opening or by plurally forming the first discharge openings, the second introduction openings, and the second discharge openings so that they can become smaller as they go in one direction, the flow uniformities of the first and second heat exchangers are improved much more.

Further, by forming the first discharge opening, the second introduction opening, and the second discharge opening in the form of slits, the gaps of which become gradually smaller as they go in one direction, the flow uniformity is maximized.

As mentioned above, according to the present invention, the heat exchange efficiency of the heat exchanger unit is improved by improving the flow uniformities of the first and second heat exchangers, thereby improving the dehumidifying efficiency of the air conditioning apparatus.

Although the present invention is shown and described in relation to the preferred embodiments for exemplifying the principle of the present invention, the present invention is not limited to the constitution and operation shown and described above. It will be apparent to those skilled in the art that various modifications and variations can be made in the present invention without departing from the sprit and scope of the appended claims. Thus, it is intended that the present invention covers the modifications and variations of this invention and their equivalents.

What is claimed is:

1. A heat exchanger unit comprising:

a first heat exchanger including, a first body in which a plurality of first slits through which exterior air passes are formed and a plurality of first interior passages are formed between the first slits, a first introduction opening provided at an upper end portion of the first body, through which reproduction air for exchanging heat with the exterior air is introduced, and a first discharge opening formed at a corner portion on one side of a lower end portion of the first body and having an elliptic shape, the major axis of which is disposed from one side of the first body to the other side thereof; and a second heat exchanger including:

a second body in which a plurality of second slits through which the exterior air passes are formed and a plurality of second interior passages are formed between the second slits, a second introduction opening connected to the first discharge opening, provided at a corner portion on one side of a lower portion of the second body, and having a shape corresponding to that of the first discharge opening, and a second discharge opening provided at a corner portion on the other side of an upper end portion of the second body, for discharging the reproduction air introduced through the second introduction opening from the second body.

2. The heat exchanger unit according to claim 1, wherein the first heat exchanger includes at least one first auxiliary discharge opening separated from the first discharge opening toward the other side in the first body, and the second heat exchanger includes at least one second auxiliary introduction opening connected to the first auxiliary discharge opening and separated from the second introduction opening toward the other side in the second body.

3. The heat exchanger unit according to claim 2, wherein the first auxiliary discharge opening and the second auxiliary introduction opening are smaller than the first discharge opening and the second introduction opening, respectively.

4. The heat exchanger unit according to claim 3, wherein a plurality of first auxiliary discharge openings are formed in the first body so as to become gradually smaller as they go from the first discharge opening toward the other side, and a plurality of second auxiliary introduction openings are formed in the second body so as to become gradually smaller as they go from the second introduction opening toward the other side.

5. The heat exchanger unit according to claim 1, wherein a plurality of second discharge openings are provided in the second body so as to become gradually smaller as they go from the other side of an upper end portion of the second body toward one side thereof.

6. A heat exchanger unit comprising:

a first heat exchanger including, a first body in which a plurality of first slits through which exterior air passes are formed and a plurality of first interior passages are formed between the first slits, a first introduction opening provided at an upper end portion of the first body, through which reproduction air for exchanging heat with the exterior air is introduced, and a plurality of first discharge openings provided so as to become gradually smaller as they go from a corner portion on one side of a lower end portion of the first body toward a corner portion on the other side of a lower end portion thereof, for discharging the reproduction air introduced through the introduction opening from the first body; and a second heat exchanger including, a second body in which a plurality of second slits through which the exterior air passes are formed and a plurality of second interior passages are formed between the second slits, a second introduction opening connected to at least one of the first discharge openings and provided at a lower end portion of the second body so as to correspond to said at least one of the first openings, and a second discharge opening provided at a corner portion on the other side of an upper end portion of the second body, for discharging the reproduction air introduced through the second introduction opening from the second body.

7. The heat exchanger unit according to claim 6, wherein a plurality of second discharge openings are provided in the second body so as to become gradually smaller as they go from the other side of an upper end portion of the second body toward one side thereof.

8. A heat exchanger unit comprising:

a first heat exchanger including, a first body in which a plurality of first slits through which exterior air passes are formed and a plurality of first interior passages are formed between the first slits, a first introduction opening provided at an upper end portion of the first body, for introducing reproduction air for exchanging heat with the exterior air, and a first discharge opening provided in the form of a slit so that a gap thereof becomes gradually smaller as it goes from a corner portion on one side of a lower end portion of the first body toward a corner portion on the other side of a lower end portion thereof, for discharging the reproduction air introduced through the first introduction opening from the first body; and a second heat exchanger including, a second body in which a plurality of second slits through which the exterior air passes are formed and a plurality of second interior passages are formed between the second slits, a second introduction opening connected to the first discharge opening and provided in the form of a slit so that a gap thereof becomes gradually smaller as it goes from a corner portion on one side of a lower end portion of the second body toward a corner portion on the other side of a lower end portion thereof, and a second discharge opening provided at a corner portion on the other side of an upper end portion of the second body, for discharging the reproduction air introduced through the second introduction opening from the second body.

9. The heat exchanger unit according to claim 8, wherein the second discharge opening is provided in the form of a slit so that the gap thereof becomes gradually smaller as it goes from a corner portion on the other side of an upper end portion of the second body toward a corner portion on one side of an upper end portion thereof.

10. An air conditioning apparatus comprising:

a desiccant unit absorbing moisture from exterior air;

an exterior air fan motor unit absorbing the exterior air to the desiccant unit and discharging the exterior air from which the moisture is removed by the desiccant unit to the outside;

a heater unit heating reproduction air to remove the moisture absorbed by the desiccant unit;

a reproduction air fan motor unit for blowing the reproduction air heated by the heater unit to the desiccant unit;

a first heat exchanger including a first body in which an interior passage is formed, a first introduction opening provided at an upper end portion of the first body, through which the reproduction air, which has passed the desiccant unit, is introduced into the interior of the first body, and a first discharge opening formed at a corner portion on one side of a lower end portion of the first body and having an elliptic shape, the major axis of which is disposed from one side of the first body to the other side thereof so that the reproduction air can uniformly flow in the interior passage of the first body, for discharging the reproduction air introduced through the first introduction opening from the first body; and a second heat exchanger including a second body in which an interior passage is formed, a second introduction opening connected to the first discharge opening, provided at a corner portion on one side of a lower portion of the second body, and having an elliptic shape corresponding to that of the first discharge opening, and a second discharge opening provided at a corner portion on the other side of an upper end portion of the second body, for discharging the reproduction air introduced through the second introduction opening to the fan motor unit for reproduction air.

11. The air conditioning apparatus according to claim 10, wherein the first heat exchanger includes at least one first auxiliary discharge opening separated from the first discharge opening toward a corner portion on the other side in the first body, and the second heat exchanger includes at least one second auxiliary introduction opening connected to the first auxiliary discharge opening and separated from the second introduction opening toward the other side in the second body.

12. The air conditioning apparatus according to claim 11, wherein the first auxiliary discharge opening and the second auxiliary introduction opening are smaller than the first discharge opening and the second introduction opening, respectively.

13. The air conditioning apparatus according to claim 12, wherein a plurality of first auxiliary discharge openings are formed in the first body so as to become gradually smaller as they go from the first discharge opening toward the other side, and a plurality of second auxiliary introduction openings are formed in the second body so as to become gradually smaller as they go from the second introduction opening toward the other side.

14. The air conditioning apparatus according to claim 10, wherein a plurality of second discharge openings are provided in the second body so as to become gradually smaller as they go from the other side of an upper end portion of the second body toward one side thereof.

15. An air conditioning apparatus comprising:

a desiccant unit absorbing moisture from exterior air;

an exterior air fan motor unit absorbing the exterior air to the desiccant unit and discharging the exterior air from which the moisture is removed by the desiccant unit;

a heater unit heating reproduction air to remove the moisture absorbed by the desiccant unit;

a reproduction air fan motor unit for blowing the reproduction air heated by the heater unit to the desiccant unit;

a first heat exchanger including a first body in which an interior passage is formed, a first introduction opening provided at an upper end portion of the first body, for introducing the reproduction air, which has passed through the desiccant unit, into the interior of the first body, and a plurality of first discharge openings provided so as to become gradually smaller as they go from a corner portion on one side of a lower end portion of the first body toward a corner portion on the other side of a lower end portion thereof, for discharging the reproduction air introduced through the first introduction opening from the first body; and a second heat exchanger including a second body in which an interior passage is formed, a plurality of second introduction openings connected to the first discharge openings and provided in the second body so as to become gradually smaller as they go from a corner portion on the other side of the second body toward a corner portion on the other side thereof, and a second discharge opening provided at a corner portion on the other side of an upper end portion of the second body, for discharging the reproduction air introduced through the second introduction opening to the fan motor unit for reproduction air.

16. The air conditioning apparatus according to claim 15, wherein a plurality of second discharge openings are provided in the second body so as to become gradually smaller as they go from the other side of an upper end portion of the second body toward one side thereof.

17. An air conditioning apparatus comprising:

a desiccant unit absorbing moisture from exterior air;

an exterior air fan motor unit absorbing the exterior air to the desiccant unit and discharging the exterior air from which the moisture is removed by the desiccant unit;

a heater unit heating reproduction air to remove the moisture absorbed by the desiccant unit;

a reproduction air fan motor unit for blowing the reproduction air heated by the heater unit to the desiccant unit;

a first heat exchanger including a first body in which an interior passage is formed, a first introduction opening provided at an upper end portion of the first body, for introducing the reproduction air, which has passed through the desiccant unit, into the interior of the first body, and a first discharge opening provided in the form of a slit the gap of which becomes gradually smaller as it goes from a corner portion of one side of a lower end portion of the first body toward a corner portion on the other side thereof, for discharging the reproduction air introduced through the first introduction opening from the first body; and a second heat exchanger including a second body in which an interior passage is formed, a second introduction opening provided in the form of a slit the gap of which becomes gradually smaller as it goes from a corner portion of one side of a lower end portion of the second body toward a corner portion on the other side thereof, and a second discharge opening provided at a corner portion on the other side of an upper end portion of the second body, for discharging the reproduction air introduced through the second introduction opening from the second body.

18. The air conditioning apparatus according to claim 17, wherein the second discharge opening is provided in the form of a slit, a gap of which becomes gradually smaller as it goes from a corner portion of the other side of an upper end portion of the second body toward a corner portion on one side of an upper end portion thereof.

* * * * *